US006560815B1

(12) United States Patent
Brennan et al.

(10) Patent No.: US 6,560,815 B1
(45) **Date of Patent: *May 13, 2003**

(54) MOP SQUEEZING

(75) Inventors: James William Brennan, Redfern (AU); Peter Russell Brewer, Woollahra (AU); Arthur Richard Carlson, Hawthorn East (AU)

(73) Assignee: Decor Corporation PTY LTD, The Scoressy Vic (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/242,354

(22) PCT Filed: Aug. 13, 1997

(86) PCT No.: PCT/AU97/00570

§ 371 (c)(1),
(2), (4) Date: Feb. 12, 1999

(87) PCT Pub. No.: WO98/06316

PCT Pub. Date: Feb. 19, 1998

(30) Foreign Application Priority Data

Aug. 14, 1996 (AU) ..... PO1641
Apr. 4, 1997 (AU) ..... PO5986

(51) Int. Cl.[7] ..... A47L 13/14
(52) U.S. Cl. ..... 15/260; 15/264
(58) Field of Search ..... 15/244.2, 119.2, 15/260, 261, 264

(56) References Cited

U.S. PATENT DOCUMENTS

| | | | | | |
|---|---|---|---|---|---|
| 603,547 | A | * | 5/1898 | Wolff | 15/260 |
| 2,851,710 | A | | 9/1958 | Leach | |
| 2,893,033 | A | | 7/1959 | Vosbikian et al. | |
| 3,299,458 | A | | 1/1967 | Royalty | |
| 3,341,876 | A | * | 9/1967 | Campbell | 15/260 |
| 3,562,841 | A | | 2/1971 | Royalty | |
| 3,704,480 | A | * | 12/1972 | Whitaker | 15/244.2 |
| 3,991,431 | A | | 11/1976 | Thielen | |
| 4,161,799 | A | * | 7/1979 | Sorrels | 15/264 |
| 4,580,307 | A | * | 4/1986 | Moss | 15/261 |
| 4,625,356 | A | | 12/1986 | Meili | |
| 5,333,353 | A | | 8/1994 | Taylor | |
| 5,502,858 | A | | 4/1996 | Hoagland et al. | |
| 5,956,795 | A | * | 9/1999 | Hirse | 15/260 |

FOREIGN PATENT DOCUMENTS

| | | | | |
|---|---|---|---|---|
| DE | 9415002 | | 11/1994 | |
| FR | 1356255 | | 6/1964 | |
| FR | 1389562 | * | 1/1965 | 15/244.2 |
| GB | 330543 | * | 6/1930 | 15/261 |
| GB | 2242825 | | 10/1991 | |
| WO | 9415520 | | 7/1994 | |

* cited by examiner

*Primary Examiner*—Terrence R. Till
(74) *Attorney, Agent, or Firm*—James Ray & Associates

(57) ABSTRACT

A mop squeezing device is provided for co-operation with a mop head of a mop (49). The mop (49) has a mop head backing (53) which carries mop material (55). The device has a mop surface engaging face (17) and displaced opposite said face (17) abutment means (19). In use the mop head is placed between the mop surface engaging face (17) and the abutment means (19) and the handle of the mop cranked. This, in turn, compresses the mop material (55) and squeezes liquid from the mop material (55). A mop having a backing for mop material is also provided. A two axis swivel connector is provided between the mop head and a mop handle. This allows the mop head to assume multi-axis of orientation during operation.

9 Claims, 8 Drawing Sheets

FIG. 6.
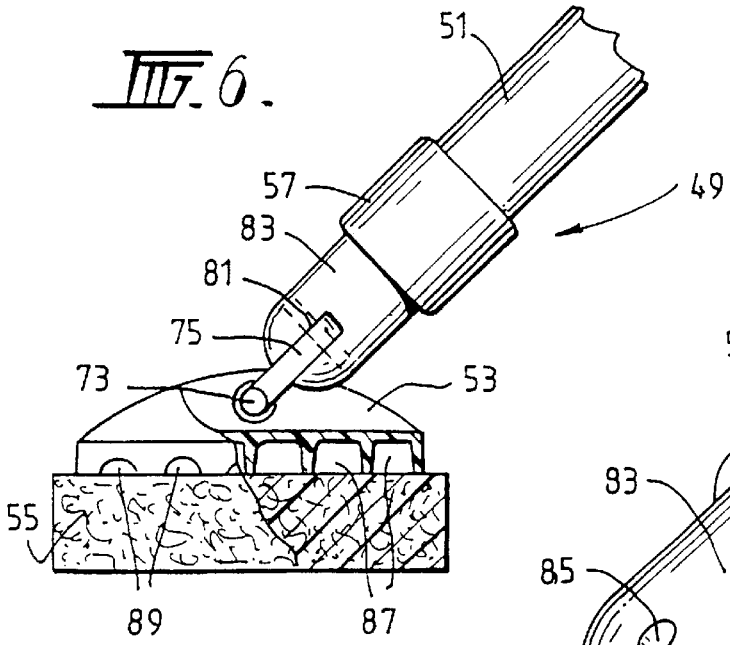
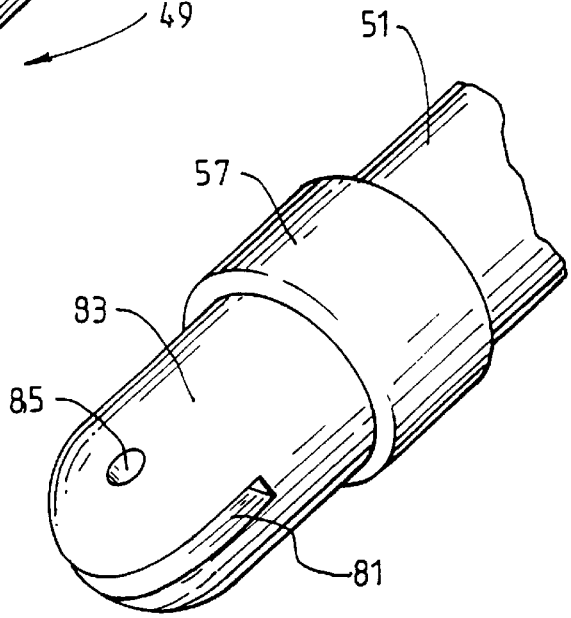
FIG. 9.
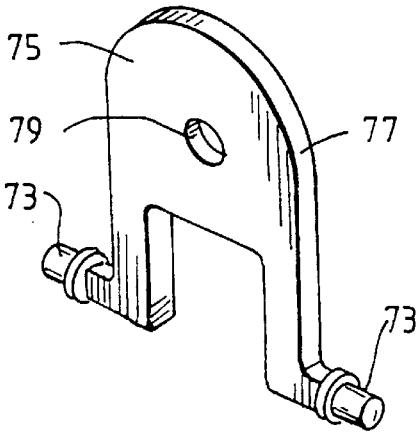
FIG. 8.
FIG. 7.
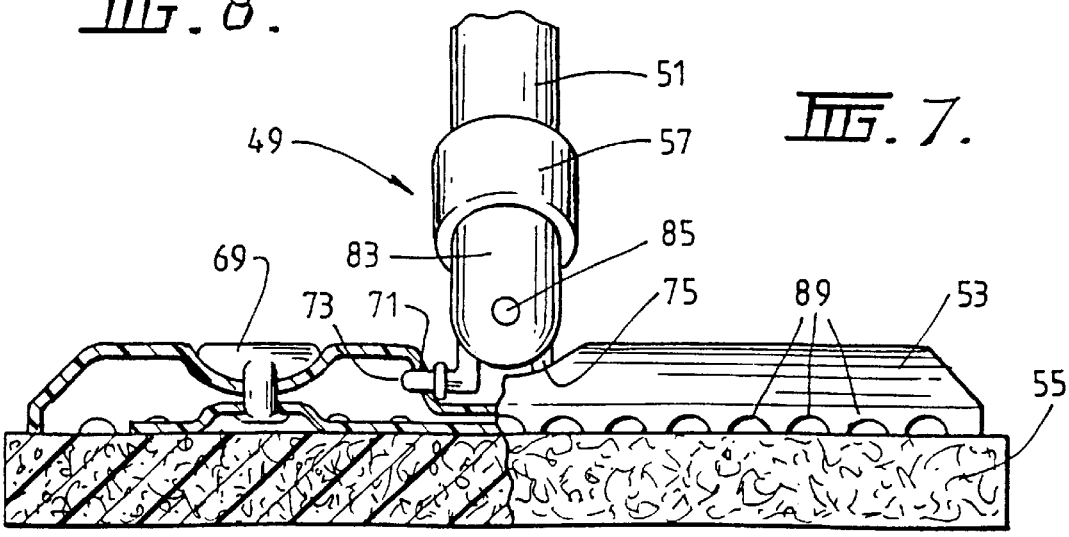

MOP SQUEEZING

FIELD OF THE INVENTION

This invention relates to mop squeezing and relates particularly but not exclusively to mop squeezing for mops having a synthetic foam head.

DESCRIPTION OF PRIOR ART

Hitherto, it has been known to use mops having a synthetic foam head or like mop head surface which can be compressed to squeeze the mop. In some cases the mop head has two wings which can be folded over on to one another to compress the mop surface. Such mops incorporate complicated mechanisms to permit the folding over of the mop wings. This in turn, increases costs.

In traditional mops which have cotton or like threads, it has been known to use a mop bucket which has a roller mechanism at the top which can be operated by a foot pedal to, in turn, compress the mop head to squeeze liquids therefrom. Such buckets and mechanisms are quite costly.

OBJECT AND STATEMENT OF THE INVENTION

It is therefor an object of the present invention to provide a mop squeezing device for a mop having a synthetic foam or like material surface which attempts to overcome one or more of the problems of the prior art.

Therefore according to a first broad aspect of the present invention there is provided a mop squeezing device for co-operation with a mop head having a synthetic foam or like mop surface which can be compressed to squeeze said mop, said mop squeezing device having a mop surface engaging face and displaced opposite to said face, abutment means for engagement with a rear face of the mop head or a part of the mop handle, whereby said mop surface can be squeezed to displace liquids therefrom by placing said mop head between said mop surface engaging face and said abutment means with said mop surface against said mop surface engaging face and cranking said mop handle so that either said rear face of the mop head or a part of the mop handle engages said abutment means and a force can be applied by such cranking and engagement to force said mop surface onto said mop surface engaging face.

It is particularly preferred that said mop and said device be designed so that the dimension of spacing of said mop surface engaging face and said abutment means, and the dimensions of the mop head assist substantially uniform pressure forces to be applied over the whole of the mop surface to affect substantially uniform squeezing of the mop surface when said mop handle is cranked.

It is further particularly preferred that said device be incorporated in a mop bucket and that the mop surface engaging face be above an intended level of filling of liquid in said mop bucket.

It is further particularly preferred that said mop bucket have a protruding means at the bottom of the bucket which extends in a direction away from the bucket towards a free end of the mop handle when the mop head is placed between said mop surface engaging face and said abutment means so that said protruding means can be engaged by a users foot to stabilise the mop bucket during such cranking.

According to a second broad aspect of the present invention there may be provided a mop squeezing device for co-operation with a mop head having a synthetic foam or like mop surface which can be compressed to squeeze said mop, said mop squeezing device having a mop surface engaging face and displaced opposite to said face an abutment means for engaging with a rear face of the mop head or a part of the mop handle, whereby said mop surface can be squeezed to displace liquids from said mop by placing said mop head between said mop surface engaging face and said abutment means with said mop surface against said mop surface engaging face and cranking said mop handle so that either said rear face of the mop head or a part of the mop handle engages said abutment means and a force can be applied by such cranking and engagement, to force said mop surface onto said mop surface engaging face, said mop surface engaging face having a swivel axis extending in a direction along the length of the mop head when said mop head is so engaged in said device, said swivel axis permitting said mop surface engaging face to swing to, in turn, lie substantially co-plannar with the mop surface and assist in permitting substantially uniform pressure forces to be applied over the whole of the mop surface during such cranking.

It is particularly preferred in this embodiment that the direction of cranking of the mop handle be either towards said abutment means or towards said mop surface engaging face.

According to a further broad aspect of the present invention there is provided a mop having a synthetic foam or like mop surface which can be compressed to squeeze said mop, said mop surface being carried on a backing which is attached to a two axis swivel connector between said mop head and a mop handle whereby to permit the mop surface engaging face to assume multi-axis of orientation during operation relative to the longitudinal axis of the handle.

It is particularly preferred that said backing be configured with channels in abutting relation with a rear face of the mop head to assist in liquid flow during compression of the mop head.

It is particularly preferred that there be openings at the ends of such channels to permit easy flow of liquid therefrom.

It is also particularly preferred that there be openings extending transversely to the direction of said channels to further assist in flow of liquid therefrom.

In order that the invention can be more clearly ascertained examples of preferred embodiments will now be described with reference to the accompanying drawings wherein:

FIG. 6 is a side view of a preferred mop in part section.

FIG. 7 is a front view of the mop shown in FIG. 6 in part section.

FIG. 8 is an isometric view of part of a swivel of the mop and;

FIG. 9 is an isometric view of a further part of the swivel of the mop.

Figure 1:
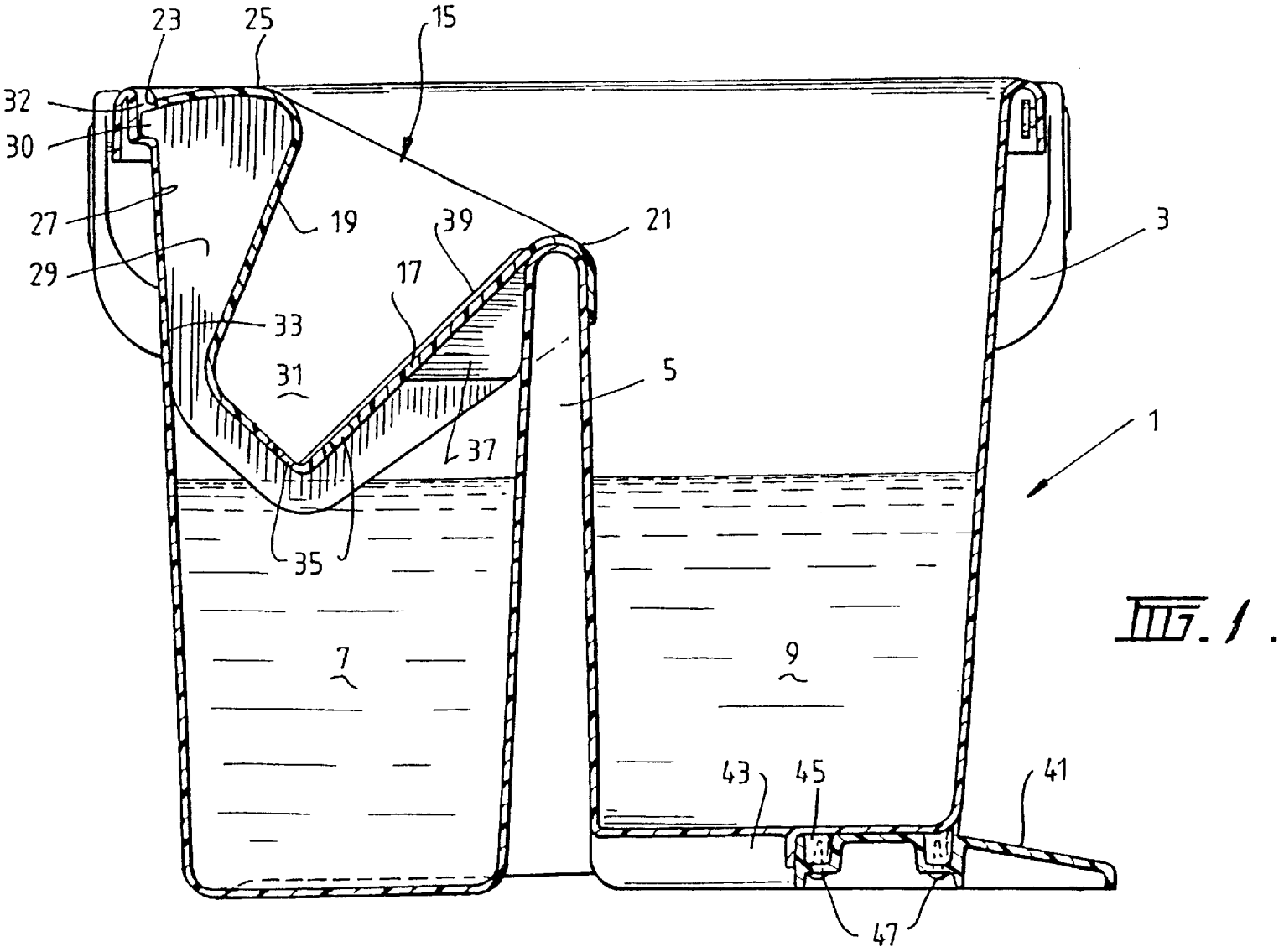
FIG. 1 is a cross-sectional side view of a mop bucket incorporating a mop squeezing device according to a first embodiment.
Figure 2:
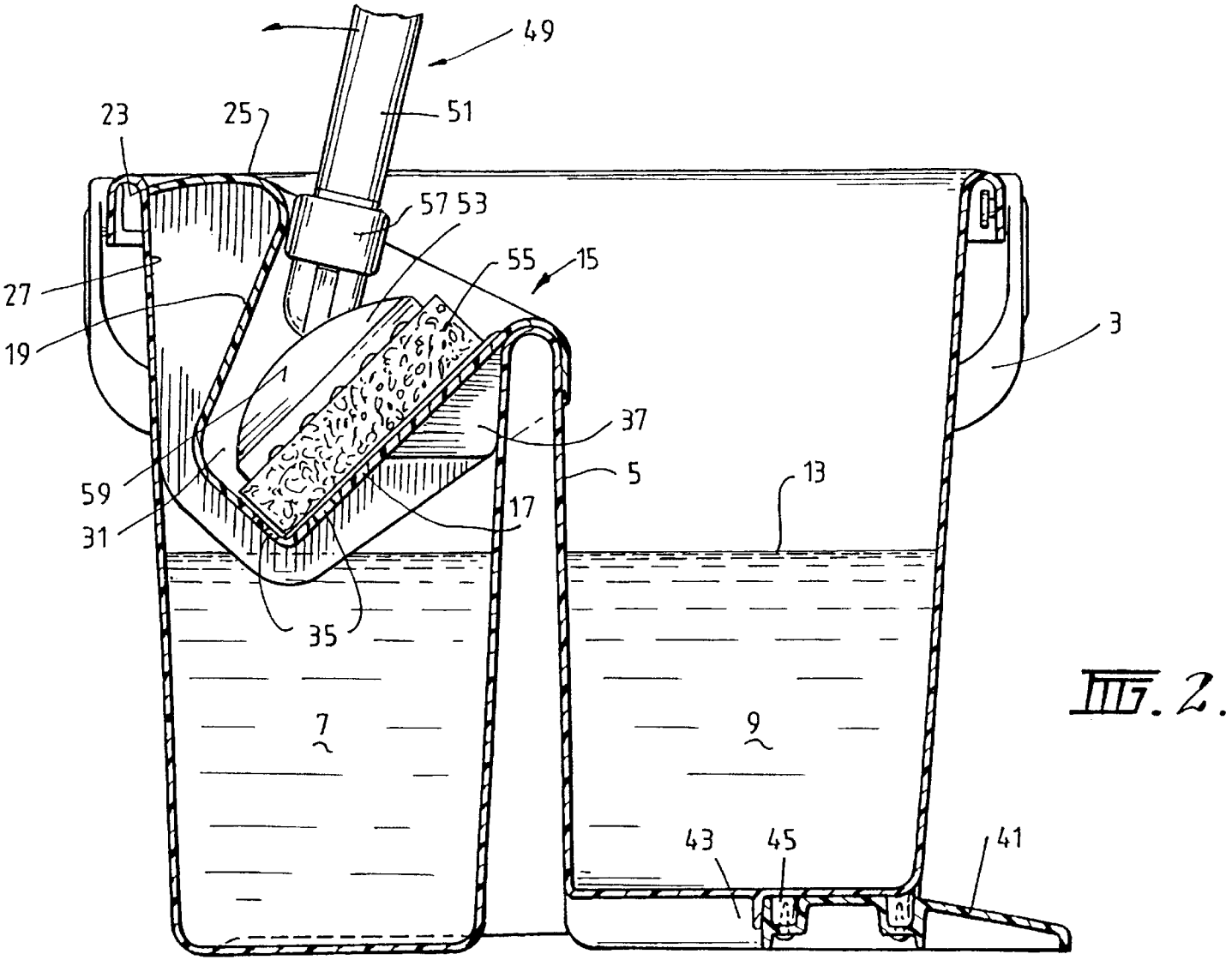
FIG. 2 is a view similar to that of FIG. 1 showing insertion of a mop head into said device.
Figure 3:
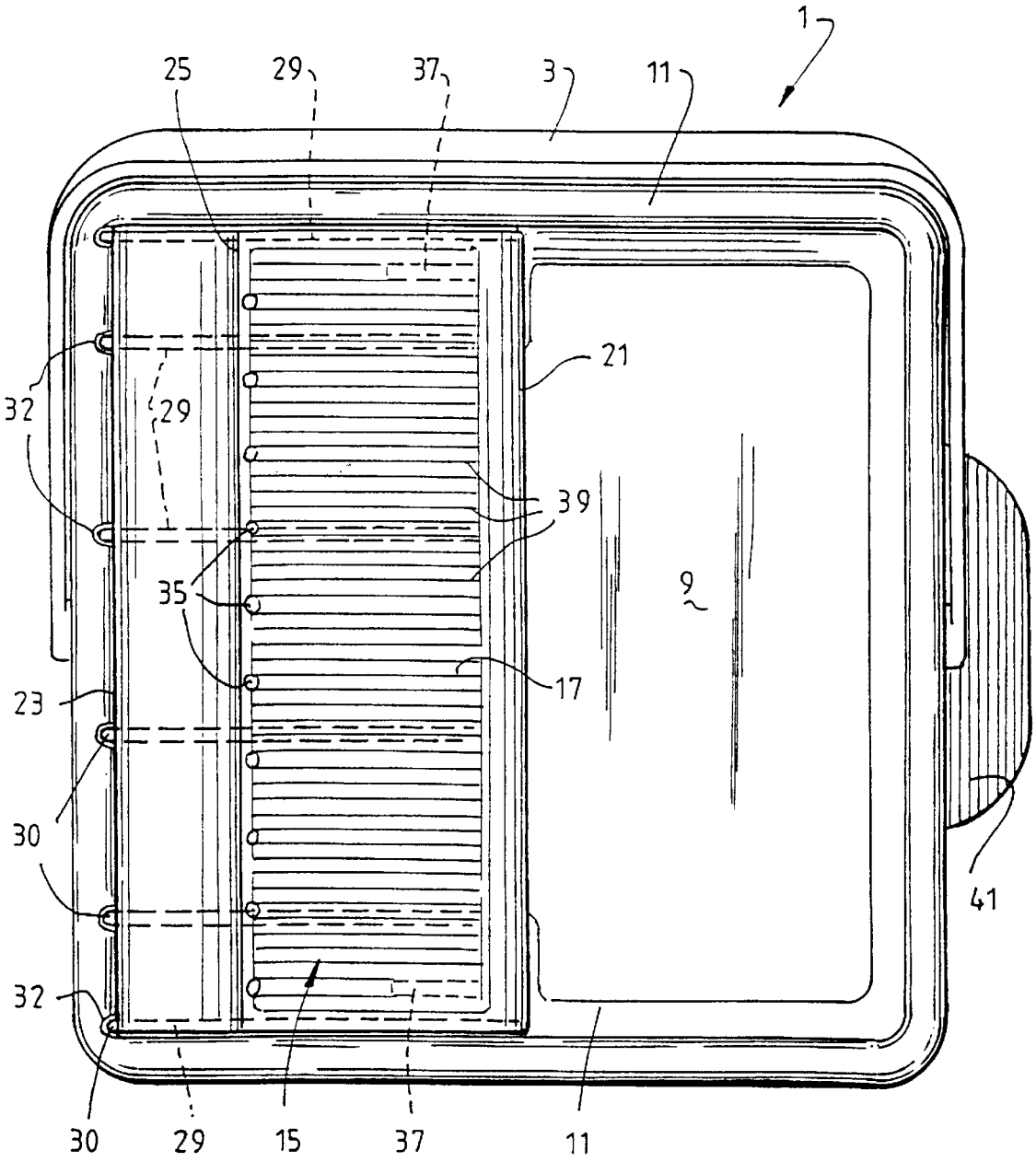
FIG. 3 is a plan view of the embodiment shown in FIGS. 1 and 2.

Referring firstly to the embodiment of FIGS. 1, 2 and 3, it can be seen that there is provided a generally rectangular shaped deep mop bucket 1. The mop bucket 1 conveniently has a handle 3 to permit easy carrying. Typically, the mop bucket can be made from a synthetic plastics material but production from other materials is not excluded. The mop bucket may be divided longitudinally by an upstanding rib 5 such that there are two compartments 7 and 9. These compartments 7 and 9 may be completely isolated from one another or alternatively liquids may be able to flow between the compartments either through openings in the upstanding rib 5 or around the ends of the upstanding rib 5 where the rib 5 either contacts with or is arranged in close proximity to the extreme side edges of the bucket 11. The bucket 1 has an intended water level height 13 which typically can be equivalent to a water volume level of 7 litres. This volume is not to be considered limiting. It is noted that the rib 5 extends above the water level height 13.

A mop squeezing device 15 is provided in the bucket 1 directly over compartment 7. The device 15 has a mop surface engaging face 17 and an abutment means 19. FIG. 3 shows that the mop surface engaging face 17 and the abutment means 19 extend substantially the width of the bucket. The device 15 can be manufactured from a synthetics plastics material or some other suitable material such as stainless steel. The choice of materials is not to be considered limiting. Typically, the device 15 is a synthetics plastics material moulded article which can be nested into the bucket 1 by an upper lip 21 locating over the uppermost portion of rib 5 and by the bottom edge 23 of a further lip 25 against the inside wall surface 27 of the bucket. Flanges 29 (see FIG. 4) may extend from the rear face of the abutment means 19 around a mop head opening 31 between the abutment means 19 and the mop surface engaging face 17 to provide support and rigidity to the abutment means and the mop surface engaging face 17 along the length of the device 5. A rear face 33 of each of the flanges 29 may terminate against the inside face 27 of the bucket 1, as shown in FIGS. 1 and 2 to provide for good support of the device 15. The tops 30 of those flanges 29 protrude into short length vertically extending recesses 32 at the top of the side wall of the bucket 1, and locates and supports the device 15 relative to the bucket. Typically the device 15 is made to be easily removed from the bucket 1 and to be easily re-inserted into the position shown. This will assist in cleaning of the various compartments 7 and 9 in the bucket 1.

It can be seen therefore, that the mop surface engaging face 17 is generally plannar and is inclined at an angle relative to the vertical. Thus, the lowermost portion of the mop head opening 31 will collect liquids squeezed from a mop head. Drainage openings 35 are provided in the bottom of the device 15 to permit escape of such liquids and to enable them to drain into compartment 7. Desirably, the openings 35 should be above the liquid level 13. FIG. 2 shows supporting surfaces 37 extending from the under surface of the mop surface engaging face 17 which are arranged to bear against one side face of the rib 5 to provide further support to the mop surface engaging face 17. This will provide additional support during compressing of the mop head against the mop surface engaging face 17.

FIG. 3 shows that the mop surface engaging face 17 is provided with a number of grooves 39 which extend in the vertical direction along the inclined face of the mop surface engaging face 17 and assist in drainage of liquids from the mop head. The grooves 39 are shown equally spaced and extending along the whole length of the mop surface engaging face 17.

The mop bucket 1 has a protruding means 41 which can be screw fastened to the undersurface of the bucket 1 in a recess 43 formed integrally in the bottom of the bucket 1. Bosses 45 may be moulded on the undersurface of the bucket 1 into which screws 47 can pass to hold the protruding means 41 relative to the bucket 1. The protruding means 41 acts as a foot engaging means to stabilise the bucket during squeezing of the mop head as will be explained in due course. The upper surface of the protruding means 41 may be lightly grooved to assist in non-slip engagement with a users foot. Typically, the protruding means 41 extends only across a part width of the bucket 1 as shown in FIG. 3. Whilst the protruding means 41 is shown as a separate item fastened to the bucket 1 it should be appreciated that it may be incorporated as an integral part of the moulding of bucket 1 if desired.

Referring now specifically to FIG. 2 it can be seen that a mop 49 having a mop handle 51, a mop head backing 53, and a synthetic foam or like material mop head 55 can be placed in the opening 31. Typically, the dimensions of the mop surface engaging face 17 are slightly larger than the corresponding dimensions of the mop material 55. FIG. 2 shows that the mop 49 has a two axis swivel connector between the mop handle 51 and the mop backing 53. This will be described further in due course. It should be noted however, that a swivel connection is not an essential feature for operation. The connection between the handle 51 and the backing 53 may be completely rigid if a mop of that type is required. This will not detract from operation of squeezing of the mop material 55.

FIG. 3 clearly shows that the mop surface which comprises the under surface of the mop material 55 is generally plannar. Thus, it corresponds to the plannar arrangement of the mop surface engaging face 17. The dimensions of spacing apart of the mop surface engaging face 17 and the abutment means 19, and the dimensions of the mop 49 and particularly the mop head 53 and the mop handle 51 are such that when the mop head is inserted in the opening 31, the handle 51 can be cranked in the direction of the arrow as shown in FIG. 2 to cause the mop handle 51 to engage with the abutment means 19. This in turn, will cause force to be applied by the cranking which will urge the mop surface into engagement with the mop surface engaging face 17 and will compress the mop material 55. Liquids will therefore drain from the mop material 55 and escape through the openings 35 into compartment 7. The dimensions and angles of inclination of the mop surface engaging face 17 are such that substantially uniform pressure forces will be applied over the whole of the mop surface and thus maximise substantially uniform squeezing of the mops material and the mop surface when the mop handle 51 is so cranked.

The protruding means 41 is engaged by a users foot to stabilise the bucket and to counter forces applied by cranking of the handle 51 which might otherwise tend to tip the bucket.

In the embodiment of FIG. 2 it is shown that the mop handle 51 (and in particular a connecting ferrule 57) engages with the abutment means 19. In an alternative arrangement, the abutment means 19 may be arranged to engage with a rear face 59 of the mop head backing 53. In this case, the mop handle 51 can be rigidly connected with the mop head backing 53 without the swivel connector. In this way, similar cranking forces can then be applied to those described above for the case where there is a swivel connector between the mop handle 51 and the mop head itself.

Figure 4:
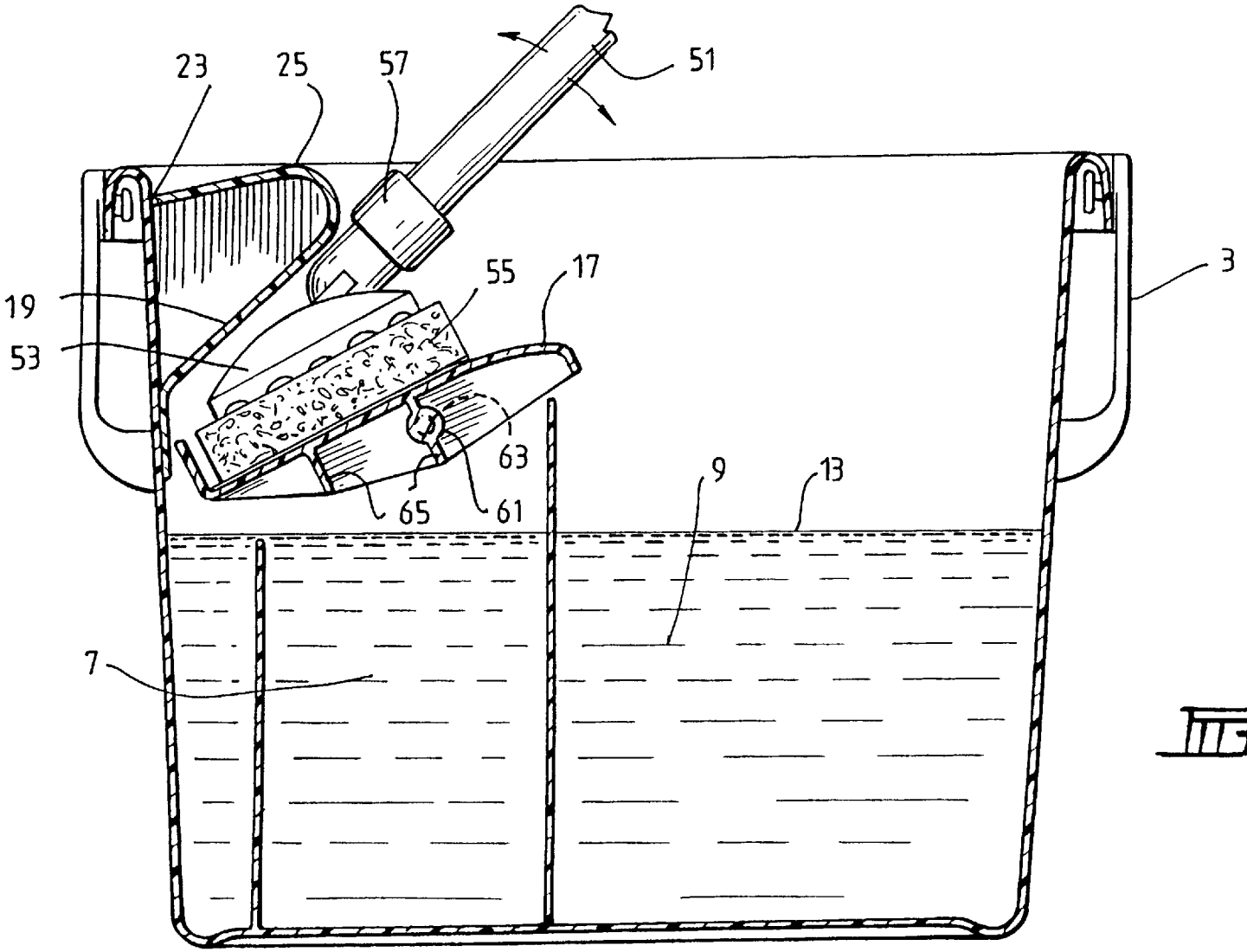
FIG. 4 is a view similar to that of FIG. 1 showing a second embodiment and having a mop head inserted in said device.
Figure 5:
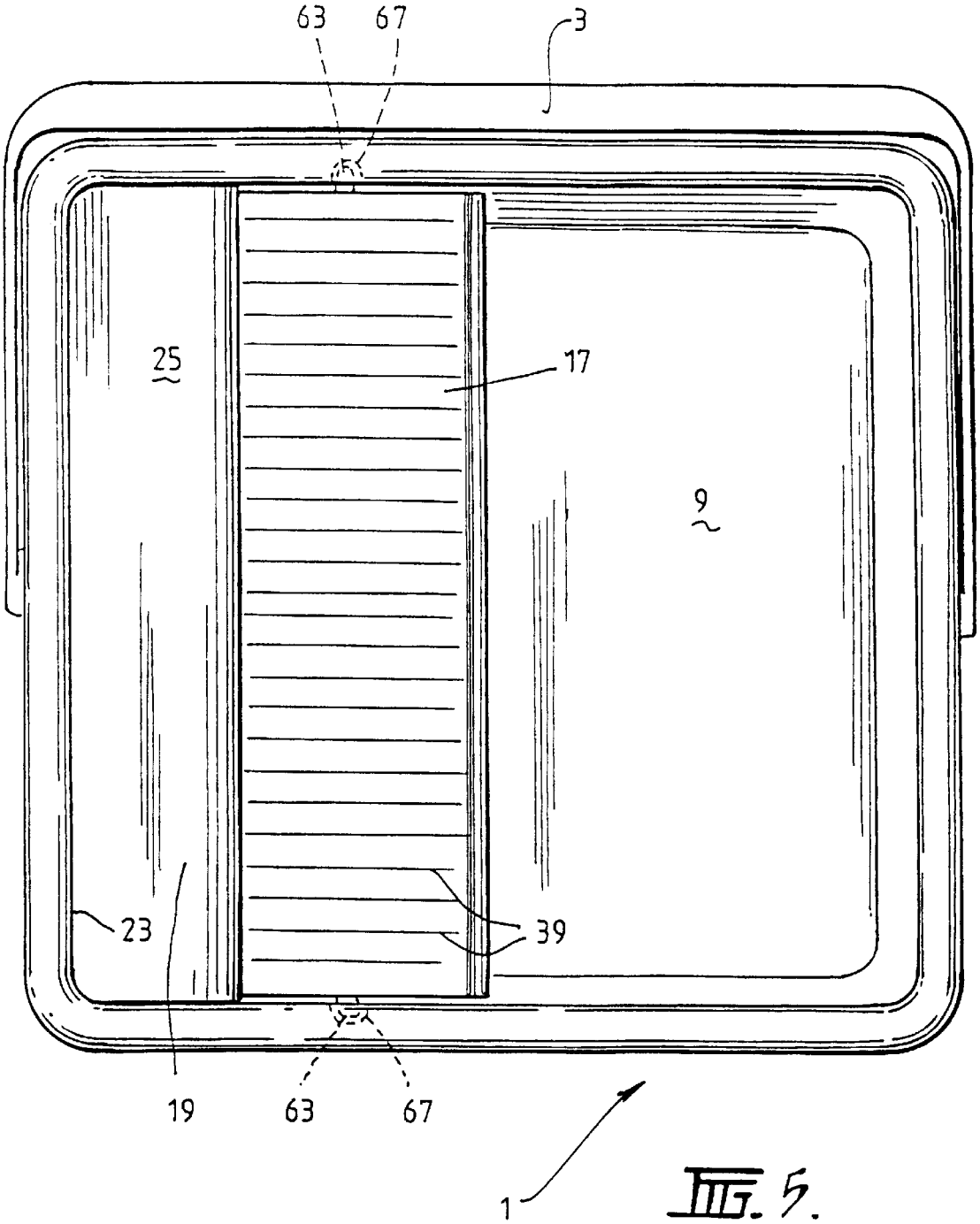
FIG. 5 is a plan view of the bucket of FIG. 4 without the mop in place.
Figure 10:
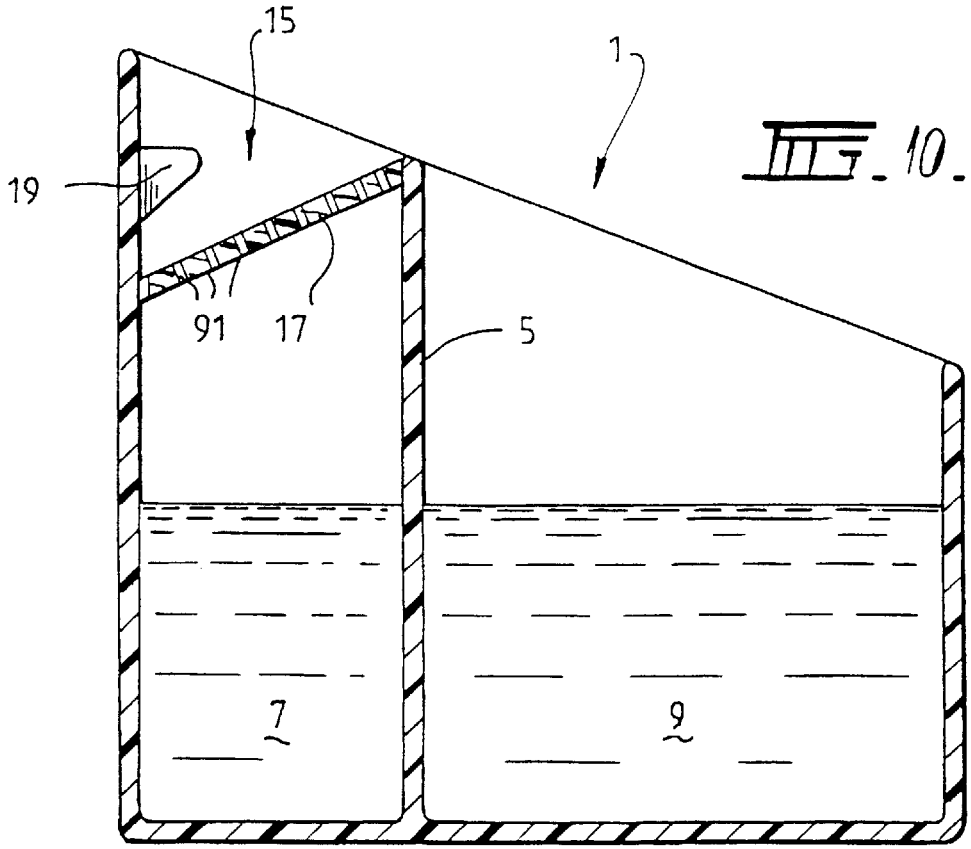
FIG. 10 is a sectional side view of mop squeezing device according to a further embodiment.

Referring now to the embodiment shown in FIGS. 4 and 5, the arrangement is generally similar to that shown in the embodiment of FIGS. 1 to 3 except that the mop engaging surface 17 is mounted for swinging movement about a swivel axis 61. It is noted that in this embodiment, the abutment means 19 is formed as a separate item to the mop surface engaging face 17.

The mop surface engaging face 17 can be pre-moulded from a synthetic plastics material or fabricated from some other material so that it has axle arms 63 extending from opposite sides (see FIG. 5). The axle arms 63 define a swivel axis 61. Suitable re-enforcing ribs 65 may be provided under the mop surface engaging face 17 as shown in FIG. 4. One of these ribs may coinside with the swivel axis 61 to provide for enhanced rigidity. The bucket 1 can have axle recesses 67 formed therein into which the axle arm 63 may locate. Thus, these axle recesses 67 will support the mop surface engaging face 17 above the liquid level height 13 and enable the mop surface engaging face to swing about the axis 61.

The abutment means 19 can be formed of a synthetics material or some other suitable material and fastened to the inside face of the bucket 1 above the mop surface engaging face 17 as shown in FIG. 4. The fastening may be by means of locating within a special recess (not shown) in the bucket 1 or by being otherwise fastened thereto such as by welding or the like or it may be integrally moulded with the bucket.

The mop surface engaging face 17 and the abutment means 19 preferably extend across the width of the bucket as shown in FIG. 5.

In this embodiment, the mop handle 51 may be cranked in either of two directions to effect squeezing of the mop head. When looking at FIG. 4, and cranking in a clockwise direction, the backing 53 will locate against the abutment means 19. The mop surface engaging face 17 will then swing about swivel axis 61 to assume a position where continued cranking of the mop handle 51 will cause the mop material 55 to be compressed to, in turn, squeeze liquid from the mop face. By cranking in a counterclockwise direction, the handle 51 will engage the abutment means 19 and the mop surface engaging face will similarly swing to permit liquids to be squeezed from the mop material 55. In both cases, the swinging will be such that substantially uniform pressure forces will be applied over the whole face of the mop material 55 so that substantially uniform squeezing of liquid from the mop material 55 will occur.

As in the case of the embodiment of FIGS. 1 through 3, and in the case of the embodiment of FIGS. 4 and 5, grooves 39 may be provided in the mop surface engaging face 17 to assist draining.

Referring now to FIGS. 6 through 9 there is shown detail of a two axis pivot head mop 49. Here the mop has a handle 51 and a backing 53 to which mop material 55 can be releasably fastened. FIG. 7 shows an arrangement where screw means 69 can be used to pass through openings (not clearly shown) in the backing 53 to hold the mop material 55 relative to the backing 53. Such connection is known in the art of foam head mops. The backing 53 has a pair of opposed recesses 71 (only one of which is shown) into which an arm 73 of a 'U' shaped swivel part 75 can be received. The 'U' shaped swivel part 75 is generally flat and has a central body portion 77 having an opening 79 extending therethrough. The flat body part 77 is arranged to fit within a slot 81 within a further swivel part 83. The further swivel part 83 has an opening 85 extending therethrough in a direction perpendicular to the plane of the slot 81. The further swivel part 83 is connectable to the handle 51 by means of a ferrule 57 which is screw threaded on to the further swivel part 83 and which has an internal bore into which the handle 51 can be screw fastened. Tightening of the ferrule 57 effects clamping to the handle 51. In this case, the handle 51 need not be screw fitable within the further swivel part 83 but may merely be a frictional fit therein a suitable opening (not shown). A screw fit is not to be excluded.

A pin (not shown) passes through the opening 85 and opening 79 to hold the two swivel parts 75 and 83 together. Thus, the arm 73 provide a first swivel axis and the pivot pin provides a further swivel axis mutually perpendicular to the axis provided by arm 73. This arrangement permits the mop head to assume various angles on a floor or other surface relative to the longitudinal axis of the handle 51.

FIGS. 6 and 7 clearly show that the backing 53 is provided with longitudinal channels 87 which extend the length of the mop head. It also shows that there are a series of openings 89 which extend around all side edges of the mop backing 53 and communicate with the channels 87 to assist draining of liquids from the mop material 55.

Referring now to FIGS. 10 through 13 there is shown a further example of a mop squeezing device. In this example, the mop bucket 1 is divided into two compartments 7 and 9 which are completely separate from one another, compartment 9 is provided for clean liquids for washing the floor or the like with a mop. Compartment 7 is provided for collecting dirty water which may be squeezed from the mop. An upstanding rib 5 separates compartment 7 from compartment 9. Mounted within an upper portion of compartment 7 is an inclined mop surface engaging face 17. This represents an inclined squeezing surface. The mop 49 has a mop head backing 53 and the handle 51 is rigidly attached to the backing 53. The backing 53 carries a synthetic foam or like mop surface 55. Mounted on a side wall of the bucket above the mop surface engaging face 17 is an abutment means 19.

In use, the mop 49 is inserted into the mop squeezing device 15 so that the backing 53 locates under the abutment means 19 and so the mop material 55 engages with the mop surface engaging face 17. The handle 51 can then be cranked in the direction shown by the arrow in FIG. 11 to effect squeezing of liquid from the mop material 55. Perforations 91 are provided in the mop surface engaging face 17 to allow water to drain therethrough and collect in the bottom of compartment 7. In some embodiments the mop surfacing engaging face 17 will have no perforations and is simply inclined to allow liquid to flow downwards to the bottom most edge and pass through an opening (not shown) into the compartment 7. In some configurations, it may be desirable that the mop surface engaging face be curved to facilitate a more progressive squeezing action across the face of the mop material 55.

Typically the mop surface engaging face can be provided from a sheet of plastics material, metal material or other suitable material.

Figure 13:
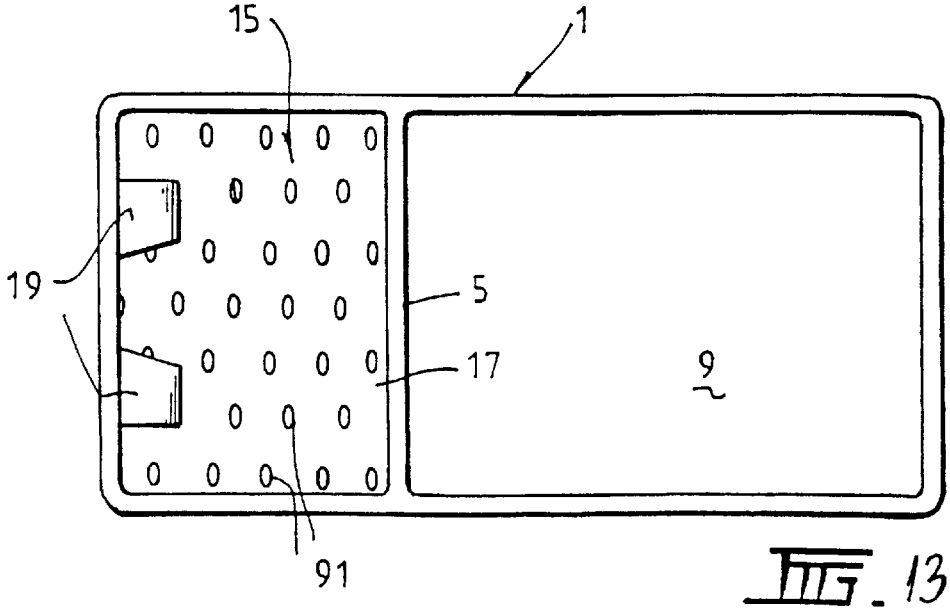
FIG. 13 is a plan view of the mop head squeezing device shown in FIG. 10.
Figure 11:
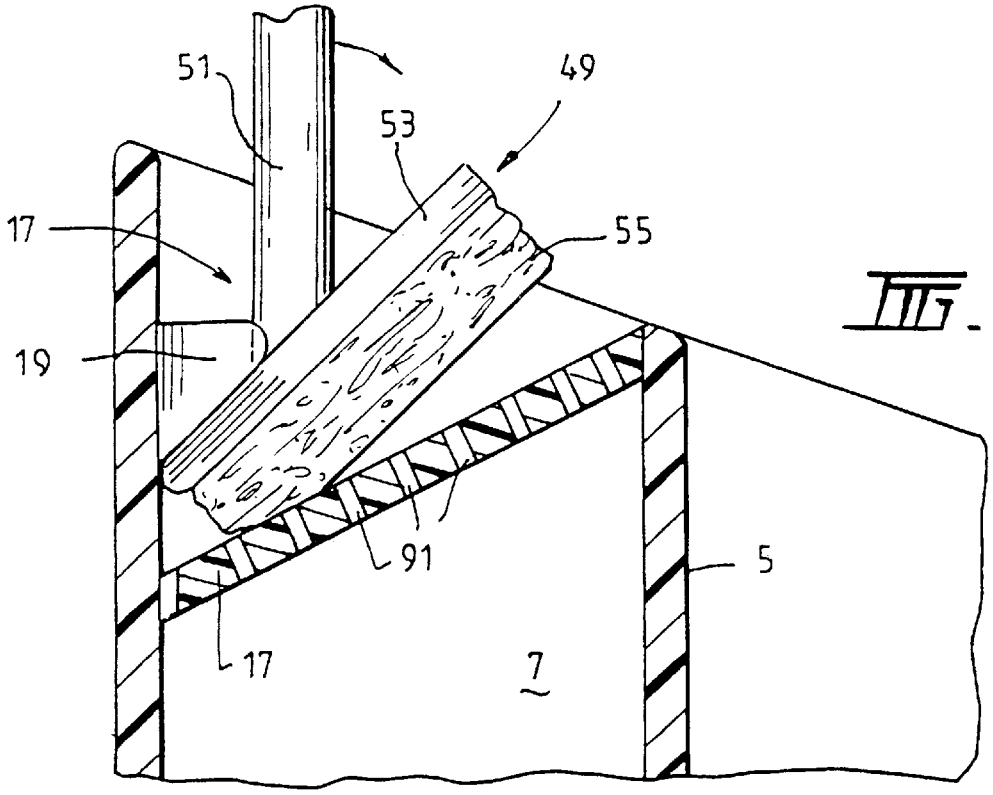
FIG. 11 is an enlarged view of a mop head and mop squeezing device of FIG. 10.
Figure 12:
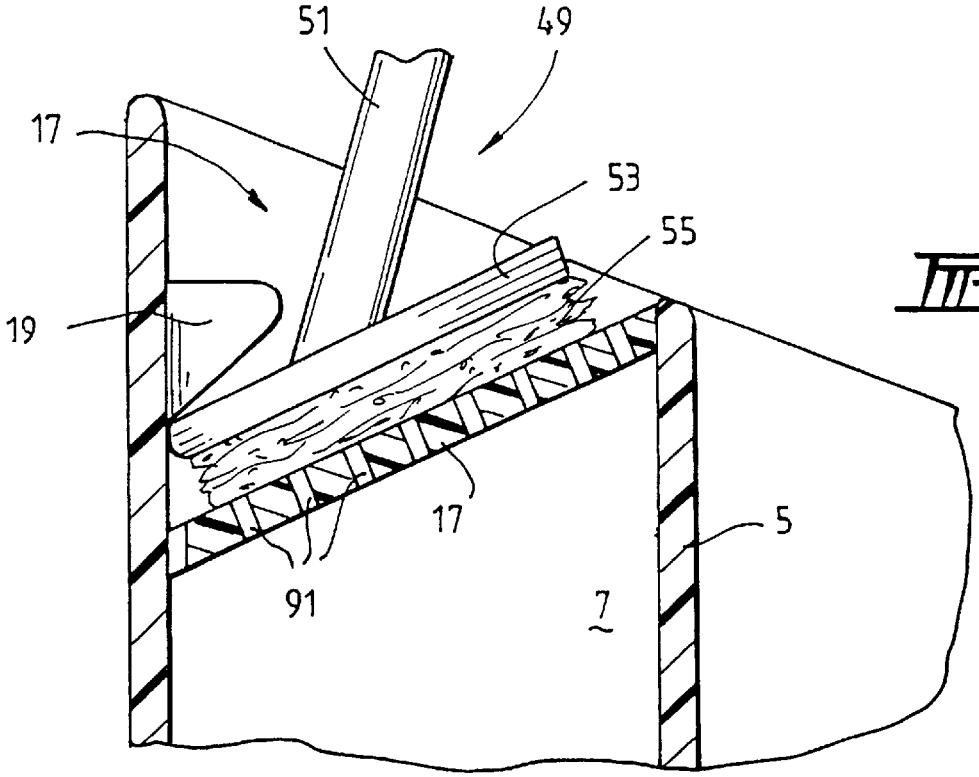
FIG. 12 is a view similar to FIG. 11 and showing the mop head being squeezed.

FIG. 13 clearly shows that the abutment means 19 comprises two spaced protrusions 19. The spacing is sufficient to allow the mop handle 51 to pass therebetween to facilitate engagement of the lowermost surfaces of the abutment means 19 with the uppermost face of the mop head backing 53.

It is envisaged that the device may be configured for retro-fitment to an existing conventional bucket. For example, the mop surface engaging face 17 and the abutment means 19 may be formed as a unit which may be realisably clipped over the rim of a bucket, thereby avoiding the need for a separate special purpose container assembly.

The embodiments provide for a simple and effective means of squeezing excess liquid from a mop head. Unlike prior art devices, the squeezing action of the present examples is relatively gentle, which significantly increases the life of the mop material 55. Furthermore, due to its simplicity, the examples are relatively cheap to manufacture. The mechanical advantage conveniently offered by the mop handle 51 also allows the device to be used with relatively little effort compared to prior art devices. For these reasons, the examples provide a number of commercially significant advantages over the prior art.

It should be appreciated that modifications may be made to the invention as would be apparent to persons skilled in the art of mops and/or buckets. These and other modifications may be made without departing from the ambit of the invention the nature of which is to be determined from the aforegoing description.

What is claimed:

1. A mop and mop squeezing device set, said mop squeezing device being for co-operation with the mop, said mop having a mop head and a mop handle, and a swivel connection connecting the mop head to the mop handle, said mop head also having a mop surface which can be compressed to squeeze said mop to displace liquids therefrom, said mop squeezing device having a mop surface engaging face and displaced opposite to said face, an abutment face for engagement with the mop handle at a position between said swivel connection and a free end of the mop and along the length of the mop handle, said abutment face and said mop surface engaging face being arranged relative to one another such that a part of said mop head can be inserted therebetween for being squeezed between said mop surface engaging face and said abutment face whereafter said mop surface can be squeezed by cranking said mop handle in a direction away from said mop surface engaging face, said direction also being in the same direction as the direction of insertion of that part of the mop head between said mop surface engaging face and said abutment face, so that the mop handle engages said abutment face at said position and a force can be applied by such cranking and engagement to force said mop surface onto said mop surface engaging face.

2. A set as claimed in claim 1 configured for use with a particular mop so that the dimension of spacing of said mop surface engaging face and said abutment face, and the dimensions of the mop head assist substantially uniform pressure forces to be applied over the whole of the mop surface to affect substantially uniform squeezing of the mop surface when said mop handle is cranked.

3. A set as claimed in claim 1 and incorporated in a mop bucket so that the mop surface engaging face is above an intended level of filling of liquid in a mop bucket into which said mop squeezing device is located.

4. A set as claimed in claim 3 wherein said mop bucket has a protruding means at the bottom of the bucket which extends in a direction away from the bucket towards a user inserting the mop head into the mop squeezing device between said mop surface engaging face and said abutment face so that said protruding means can be engaged by the user's foot to stabilize the mop bucket during such cranking.

5. A set as claimed in claim 1 wherein said mop surface engaging face has openings therein to allow liquid squeezed from said mop surface to pass therethrough.

6. A set as claimed in claim 1 wherein said mop surface engaging face is curved to facilitate uniform progressive squeezing action to said synthetic foam or like mop surface.

7. A set as claimed in claim 1 wherein said mop surface engaging face in inclined to facilitate drainage of liquid therefrom.

8. A set as claimed in claim 1 wherein said mop surface engaging face has a swivel axis extending in a direction along the length of the mop head of a mop engaged in said device, said swivel axis permitting said mop surface engaging face to swing to assist in permitting substantially uniform pressure forces to be applied over the mop surface during such cranking.

9. A set as claimed in claim 8 wherein said swivel axis is located beneath said mop surface engaging face.

* * * * *

UNITED STATES PATENT AND TRADEMARK OFFICE

CERTIFICATE OF CORRECTION

PATENT NO. : 6,560,815 B1 
DATED : May 13, 2003
INVENTOR(S) : James Williams Brennan, Peter Russell Brewer and Arthur Richard Carlson It is certified that error appears in the above-identified patent and that said Letters Patent is hereby corrected as shown below:

Title page,
Item [86], delete "PCT/AU97/00570," and insert -- PCT/AU97/00510 --

Signed and Sealed this

Twenty-second Day of June, 2004

JON W. DUDAS
*Acting Director of the United States Patent and Trademark Office*